US006364608B1

(12) United States Patent
Brainch et al.

(10) Patent No.: US 6,364,608 B1
(45) **Date of Patent: *Apr. 2, 2002**

(54) PARTIALLY COATED AIRFOIL AND METHOD FOR MAKING

(75) Inventors: Gulcharan S. Brainch, West Chester; Michael J. Danowski, Cincinnati; Roger D. Wustman, Loveland; Jonathan P. Clarke, West Chester, all of OH (US)

(73) Assignee: General Electric Company, Schenectady, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/595,868

(22) Filed: Jun. 16, 2000

Related U.S. Application Data

(62) Division of application No. 09/186,678, filed on Nov. 6, 1998, now Pat. No. 6,106,231.

(51) Int. Cl.[7] ..... F01D 5/18

(52) U.S. Cl. ..... 416/97 R; 416/95; 416/241 R; 29/889.7; 29/527.2; 415/178

(58) Field of Search ..... 416/95, 96 R, 416/97 R, 97 A, 229 A, 241 B, 241 R; 415/115, 178, 176, 200; 29/889.7, 889.71, 527.2, 527.4

(56) References Cited

U.S. PATENT DOCUMENTS 5,225,246 A * 7/1993 Beers et al. ..... 427/252

* cited by examiner

*Primary Examiner*—Edward K. Look
*Assistant Examiner*—Richard Edgar
(74) *Attorney, Agent, or Firm*—Andrew C. Hess; William Scott Andes

(57) ABSTRACT

An article comprising an airfoil surface is provided with a thermal insulating outer layer on at least one region, but not all, of the airfoil surface. The region is selected from the airfoil surface which has been observed to experience more strenuous environmental operating conditions during service operation than the airfoil surface outside of the region. In one form, the thermal insulating outer layer is applied to at least one region of each of a plurality of airfoil surfaces. Each airfoil surface is disposed about an axis of rotation with the region of each airfoil surface facing generally outwardly from the axis of rotation and from each other. The airfoil surfaces are rotated about the axis of rotation while a thermal insulating material contacts at least the regions.

4 Claims, 5 Drawing Sheets

PARTIALLY COATED AIRFOIL AND METHOD FOR MAKING

This application is a divisional of Ser. No. 09/186,678 filed on Nov. 6, 1998 Now U.S. Pat. No. 6,106,231 and claims benefit thereto.

BACKGROUND OF THE INVENTION

This invention relates to an article including an airfoil having an airfoil surface with a thermal insulating outer layer, and more particularly, to such an airfoil with such an outer layer on less than all of the airfoil surface.

Gas turbine engine components operating in the hotter sections of a gas turbine engine are subjected to or experience relatively high temperature oxidizing and corrosive conditions, as well as significant temperature variations across regions of the component. One type of such component is a blading member, including turbine blades, vanes and nozzles which include an airfoil disposed in the hot gas path of the engine. It is common practice in the gas turbine engine art to apply to an outer surface of certain of such airfoils a thermal insulating outer layer, generally in the form of an outer ceramic thermal barrier coating (TBC).

Generally the TBC, when used on a gas turbine engine component, is part of a TBC system. Such a system includes a metallic bond coat disposed on an article substrate, for example an airfoil substrate, for environmental protection and over which is applied the outer ceramic TBC for thermal insulation. A commonly used type of TBC outer layer is a thermal insulating coating based on zirconia stabilized with yttria, for example about 93 wt. % zirconia stabilized with about 7 wt. % yttria. One preferred method for application or deposition of such a TBC coating is by electron beam physical vapor deposition in a chamber in which an article to be coated is disposed and/or moved so that the TBC vapor contacts the surface to be coated. Generally a vacuum or controlled low pressure atmosphere is provided in the chamber. Apparatus of that type is sold commercially for such uses. Other coating application processes, such as plasma spray methods, can be and are used for TBC application in the gas turbine engine art. This general type of TBC has been reported in such as U.S. Pat. No. 4,055,705—Stecura et al. (patented Oct. 25, 1977); U.S. Pat. No. 4,328,285—Siemers et al. (patented May 4, 1982); and U.S. Pat. No. 5,236,745—Gupta et al. (patented Aug. 17, 1993).

Evaluation of TBC coated airfoil surfaces of such gas turbine engine articles as turbine blades, vanes and nozzles after service operation in an engine has shown that there is a variation in thermal exposure across the airfoil surface. This results in different combinations of heat loads and stresses, herein called environmental operating conditions, across the airfoil with certain airfoil regions experiencing more strenuous environmental operating conditions than other portions of the airfoil. For example for a typical air cooled turbine blade airfoil, the concave or pressure side of the airfoil and the leading edge between the concave side and the convex or suction side of the airfoil experiences more strenuous environmental operating conditions than does the convex side of the airfoil. This results in an unbalance of such conditions across the airfoil.

BRIEF SUMMARY OF THE INVENTION

The present invention, in one form, provides an article comprising an airfoil surface and a thermal insulating outer layer on at least one region of the airfoil surface, the region being less than all of the airfoil surface. The region is selected from the airfoil surface which has been observed to experience more strenuous environmental operating conditions during service operation than the airfoil surface outside of the region.

In another form, the present invention provides a method for making such an article in which a thermal insulating layer is applied to at least one region of each of a plurality of airfoil surfaces. Each airfoil surface is disposed about an axis of rotation with the region of each airfoil surface facing generally outwardly from the axis of rotation and from each other. The airfoil surfaces are rotated about the axis of rotation while a thermal insulating material contacts at least the regions.

DETAILED DESCRIPTION OF THE INVENTION

In the hotter operating sections of a gas turbine engine, for example in a high pressure turbine, components such as turbine blades can experience gas temperatures beyond the capabilities of the materials from which they are formed. To meet blade life requirements the airfoil of the blade is cooled significantly. Also, application of an outer TBC, such as the type described above, reduces the cooling heat load and cooling flow requirements which results in an increased engine performance and an increase in the operating life of the blade.

It has been a practice in such art to apply a full TBC coating to the entire outer airfoil surface, including the concave and convex sides and the leading edge spanning such sides, as well as to the blade platform surface. For example, this has been accomplished by mounting an airfoil within a chamber in which the entire airfoil is subjected to a vapor of the TBC material generated by electron beam physical vapor deposition apparatus. Frequently, the base of a blade and trailing edge cooling exits are masked.

Evaluation of service operated gas turbine engine airfoils, for example turbine blade airfoils, has shown that the environmental operating conditions, including heat load, varies over the surface of the airfoil: significantly higher heat loads (stresses resulting from thermal exposure) are experienced on the leading edge and concave side of the airfoil than on the convex side. With the airfoil fully coated with a TBC, the result is an uneven thermal match across the airfoil. According to the present invention, a thermal insulating layer, such as a TBC, is applied to at least one region of the airfoil, but not all of the airfoil, the region being selected from prior observation of the airfoil to have experienced more strenuous environmental operating conditions than the airfoil surface outside of the selected region. Such selective application of the thermal insulating layer improves the thermal match across the airfoil, reducing the thermal stresses experienced by the airfoil and leading to longer blade life. At the same time, such application maintains the resistance to environmental damage such as oxidation and corrosion to the underlying airfoil material or substrate in such region.

Figure 1:
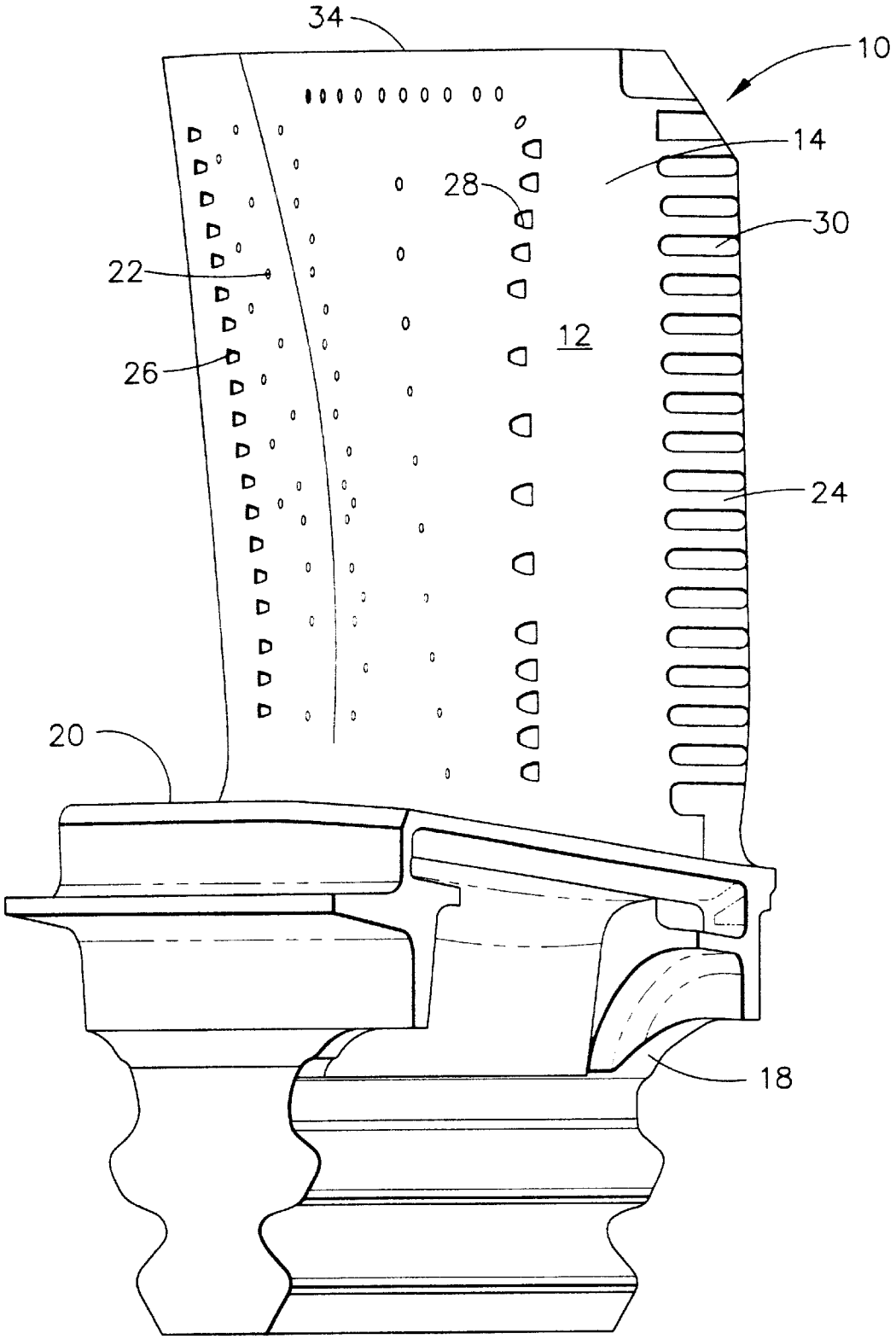
FIG. 1 is a perspective view of a typical gas turbine engine turbine blade from the concave or pressure side.
Figure 2:
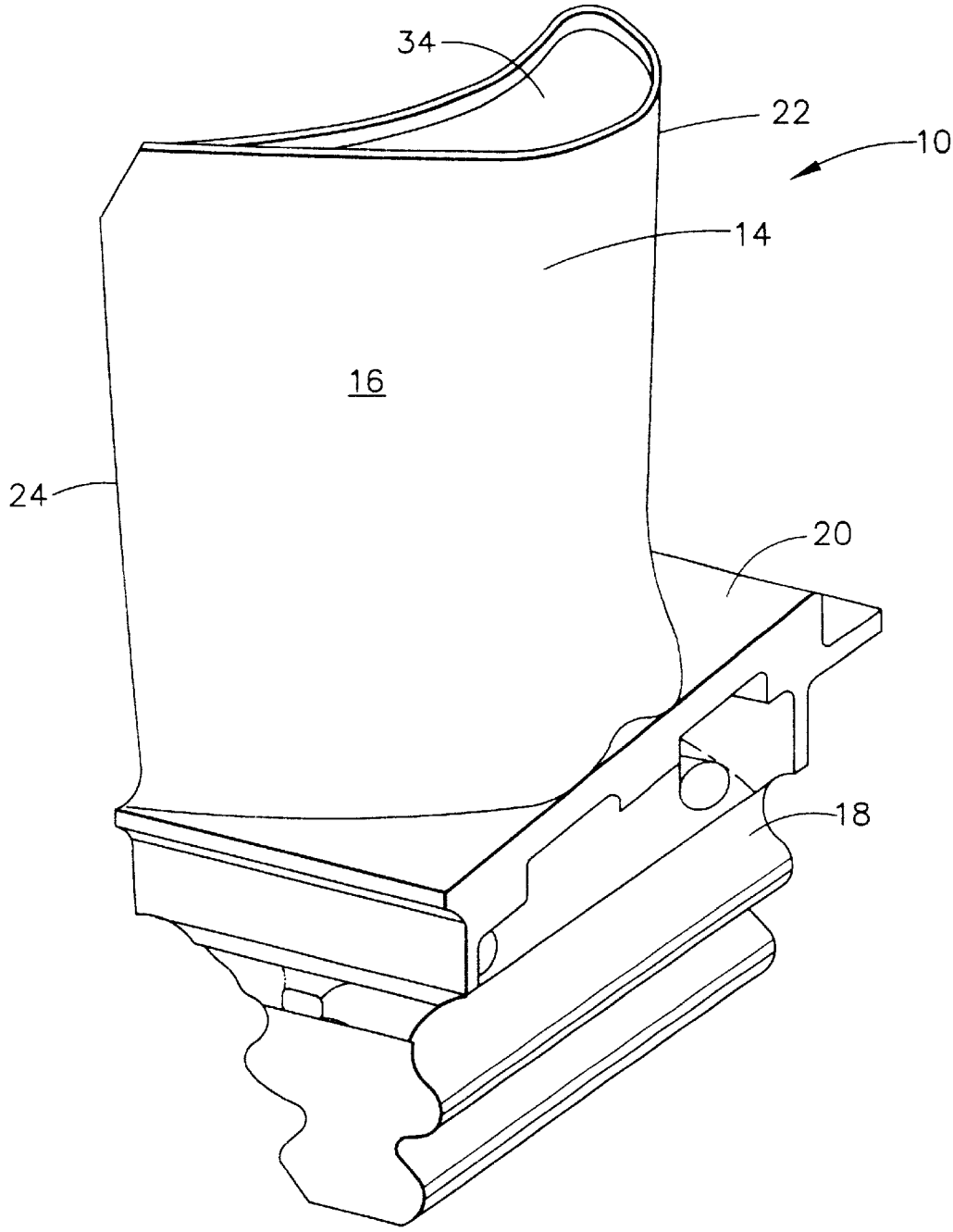
FIG. 2 is a perspective view of the blade of FIG. 1 from the convex or suction side.
Figure 4:
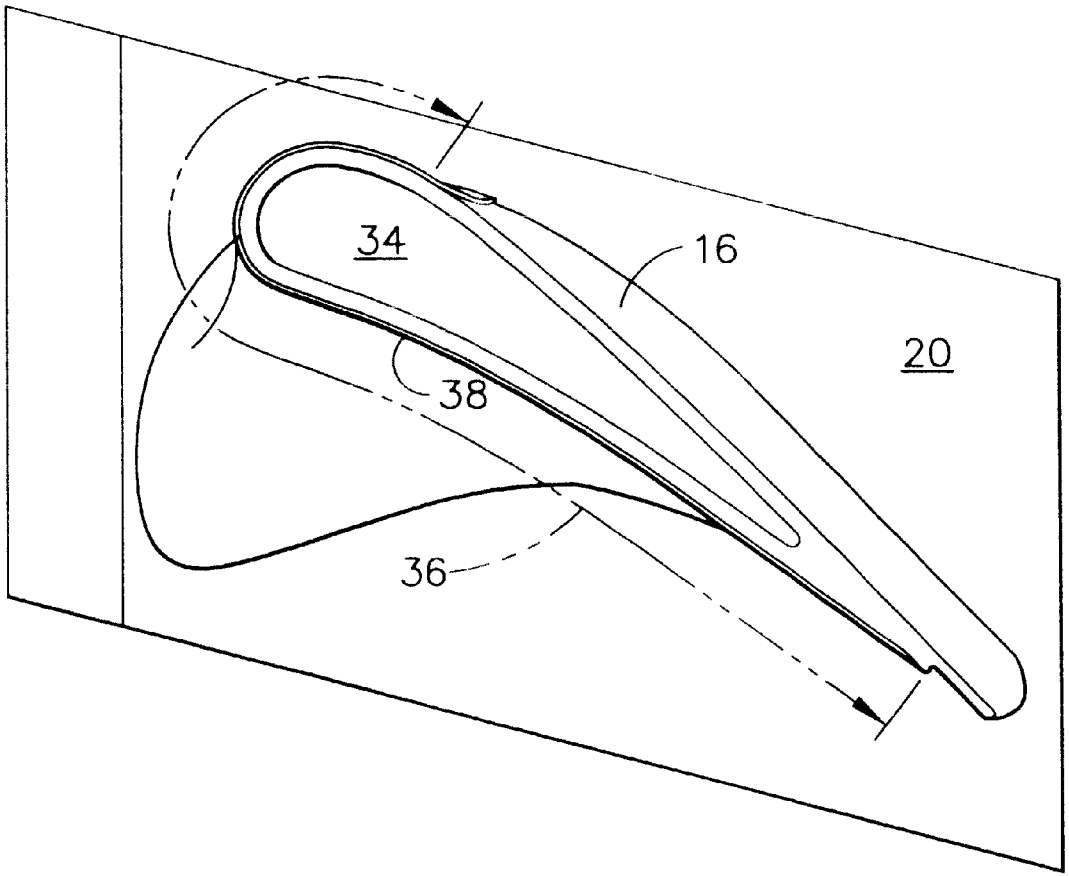
FIG. 4 is a top view of the blade of FIG. 1 after application of a thermal insulating layer to a selected airfoil region according to the present invention.

The present invention will be more fully understood by reference to the drawings. FIG. 1 is a perspective view of a typical air cooled gas turbine engine high pressure turbine blade 10 shown from the concave side 12 of airfoil 14. FIG. 2 is a perspective view of such blade 10 from the convex side 16 of airfoil 14. Blade 10 includes a base 18, with a platform 20 between base 18 and airfoil 14. Airfoil 14 includes a leading edge 22 and a trailing edge 24. The surfaces of concave side 12, convex side 14, leading edge 22 and trailing edge 24 together define the outer surface of airfoil 14. The surface of leading edge 22 can extend onto the surface of convex side 16, for example as shown in FIG. 4. Because blade 10 is air cooled, a plurality of cooling air exit or discharge openings are included in the airfoil, particularly on the concave side as shown in FIG. 1 at 26 in leading edge 22, at 28 in concave side 12, and slots at 30 in concave side 12 at trailing edge 24.

It has been common practice in the gas turbine engine art to coat the entire airfoil surface with a TBC, generally in a TBC system which includes an underlying bond coat on the airfoil substrate. According to the present invention, it was recognized that it is not necessary to coat the entire airfoil with a thermal insulating layer; and that coating at least one selected region of the airfoil which experiences more strenuous environmental operating conditions, including thermal conditions, results in an improved thermal match and reduction in thermal stresses across the airfoil. Such a region or regions of the airfoil is selected from observation of previously service operated airfoils.

Figure 3:
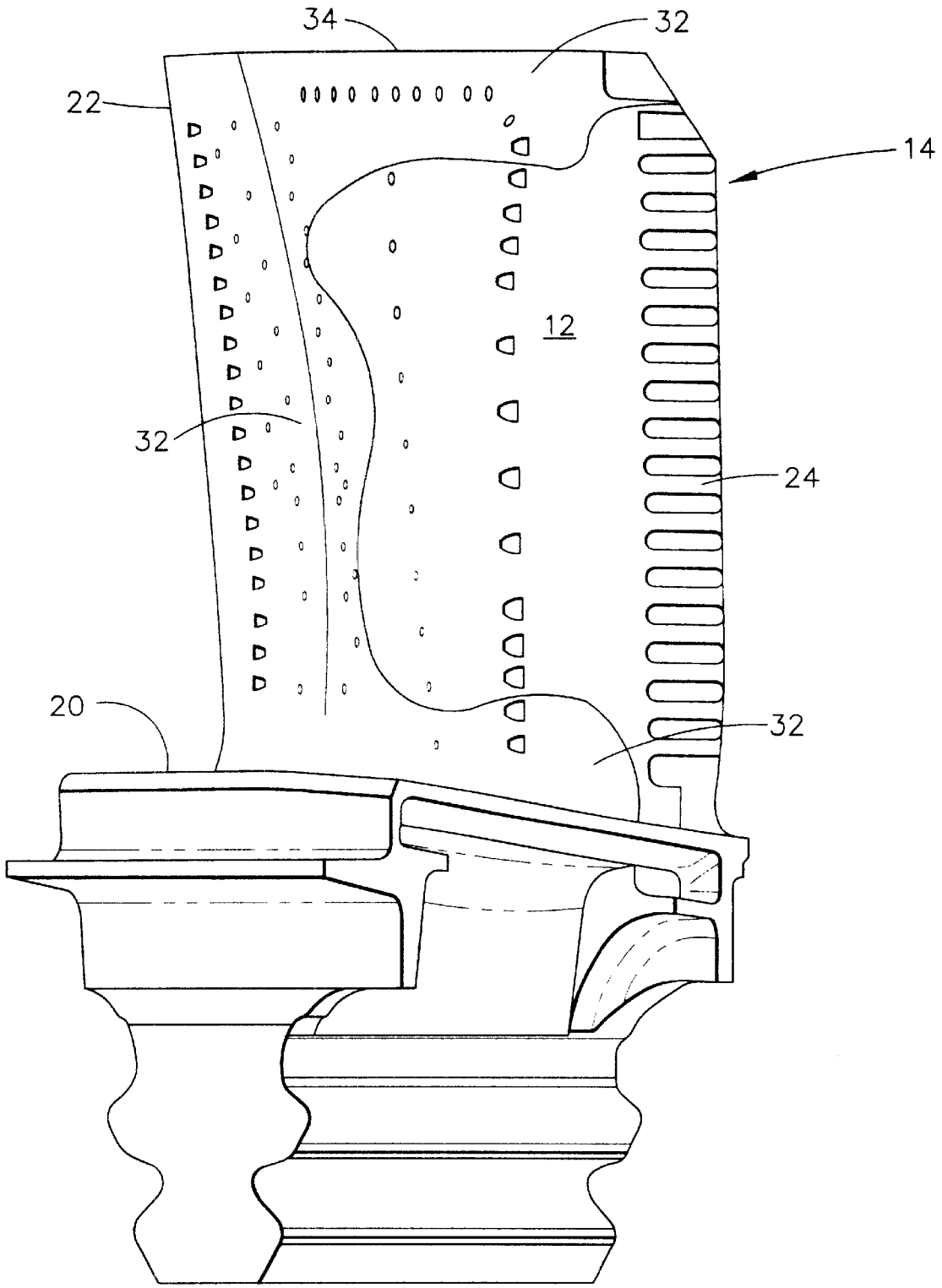
FIG. 3 is a fragmentary view of the blade of FIG. 1 after operation in a gas turbine engine, showing a typical region of the airfoil which has experienced more strenuous environmental operating conditions than other airfoil surfaces.

An example of a surface pattern representing a more strenuous environmental operating condition on the airfoil surfaces of concave side 12 and leading edge 22 of blade 10 of FIG. 1 is shown in the fragmentary view of FIG. 3. One typical surface pattern 32 extends on the surface of airfoil 14 across blade tip 34, along leading edge 22 and along airfoil surface 12 adjacent platform 20. The convex side 16 of the airfoil, an airfoil surface outside of the concave side and the leading edge, was observed to have been affected substantially less strenuously, and frequently relatively unaffected, by environmental operating conditions than were the concave side 12 and the leading edge 22. Therefore, from this example of observed experience, the concave side 12 and the leading edge 22 were selected as the region 36, FIG. 4, of the airfoil surface to be selectively coated with a partial thermal insulating layer 38 such as a TBC, according to the present invention, covering at least surface pattern 32.

Such layer 38 was not applied to the entire airfoil surface as shown in FIG. 4 which is a top view of blade 10 of FIG. 1. In this example, the convex side 16 is substantially free of layer 38 as are trailing edge cooling slots 30 which can be masked to avoid a need to unblock the slots by removing such layer from within the slots. Although the goal was to cover at least the airfoil surface at surface pattern 32, substantially the entire surfaces of concave side 12 and leading edge 22 were selected as a region, according to a form of the present invention, for convenience of thermal insulating layer application. However, one or more regions on an airfoil surface less than the entire airfoil surface, can be selected judiciously according to this invention to balance airfoil thermal stress as described above. Such region or regions can be appropriately masked if necessary, and the thermal insulating layer can be applied based on the observed experience for a particular airfoil.

One form of the present invention provides a method for making the above described airfoil with a thermal insulating layer applied to a selected region, but not all, of an airfoil surface. As was mentioned above, it is common practice to apply a thermal insulating outer layer to an entire airfoil outer surface of a single article by disposing the airfoil within a chamber in which the entire airfoil is subjected to a vapor of a thermal insulating material, such as the above described ceramic TBC material. In a method form of the present invention, each of a plurality of airfoils is disposed closely about an axis of rotation with a selected region of each airfoil surface facing generally outwardly from the axis of rotation and from each other. In that position, the airfoil surfaces are rotated about the axis of rotation while a thermal insulating material contacts the outwardly facing selected regions. The airfoil surfaces facing the axis of rotation generally mask one another from the vapor while the outwardly facing selected regions contact the vapor and are coated with the thermal insulating material. In one form, a masking member is disposed generally about the inwardly facing surfaces to block the coating vapor from contact with such surfaces.

Figure 6:
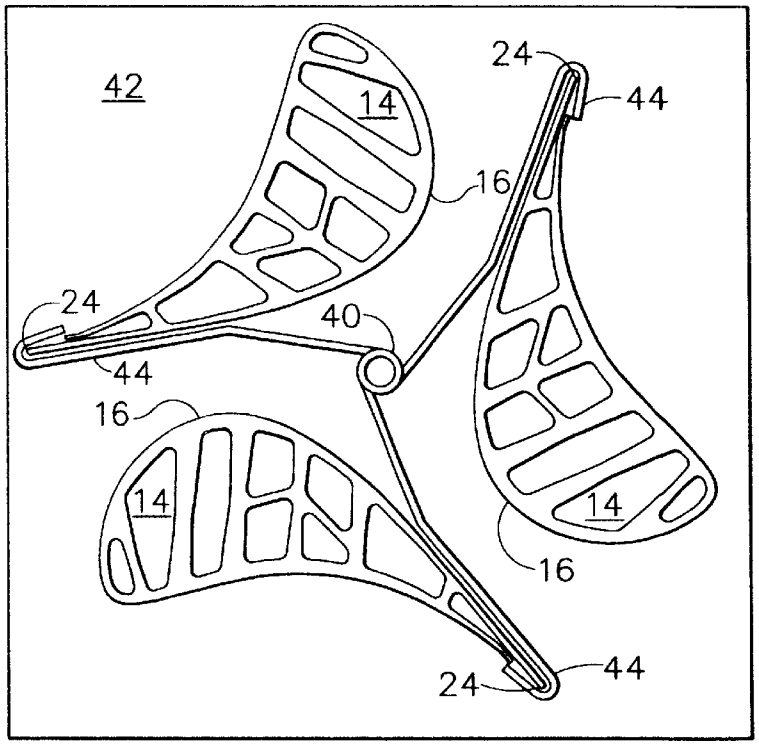
FIG. 6 is a diagrammatic top view as in FIG. 5 showing another such arrangement.
Figure 5:
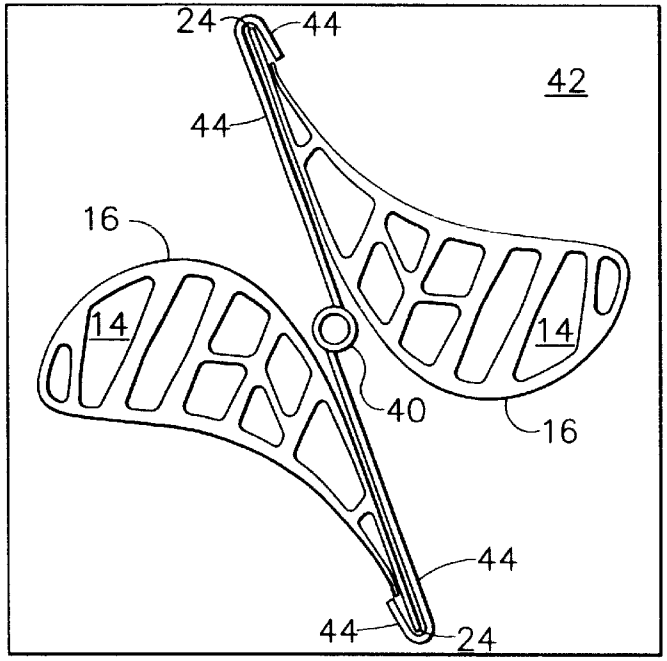
FIG. 5 is a diagrammatic top view of one arrangement toward a plurality of airfoils disposed about an axis of rotation for application of a thermal insulating layer according to the method form of the present invention.

This form of the invention will be more fully understood by reference to FIGS. 5 and 6 of the drawings. These figures are diagrammatic top views toward each airfoil 14 showing different arrangements of airfoils 14 about an axis of rotation 40 according to a form of the method of the present invention. In the examples of FIGS. 5 and 6, airfoils 14 are carried about tooling axis of rotation 40 by coating tooling represented diagrammatically by a workpiece holding member 42 which is rotated about axis 40 as shown. Although holding member 42 is shown diagrammatically as a single member for ease of presentation, an arrangement for a turbine blade carries each airfoil separately by its base. In the embodiments of FIGS. 5 and 6, the airfoils are positioned to extend, such as from blade base to blade tip in a turbine blade, generally along axis 40. However, it should be understood that other arrangements can be made, for example with the airfoil disposed at a different relationship to axis 40 so long as the selected airfoil region of each airfoil surface faces generally outwardly from the axis of rotation and from each other.

Included in the examples of FIGS. 5 and 6 is a masking means such as substantially rigid masking member 44, for example of a heat resistant non-reactive metal, disposed inwardly from airfoils 14, between the airfoils and axis 40. Masking member 44 is shaped generally to mask not only airfoil convex side 16 but also airfoil trailing edge 24 which, as shown in FIG. 1, includes cooling slots 30. Use of a masking means such as member 44 in combination with the close relative positioning of the airfoils further avoids contact within a coating chamber between a coating vapor and the airfoil surfaces other than the selected regions. This avoids any need to remove coating from the airfoil to provide a better operating thermal balance in the airfoil, to remove material from air cooling openings in the airfoil, etc.

Although the present invention has been described in connection with specific examples and embodiments, they are intended to be representative of rather than in any way limiting on the scope of the present invention. Those skilled in the arts involved will understand that the invention is capable of variations and modifications without departing from the scope of the appended claims.

What is claimed is:

1. An article comprising:

an airfoil defined by an airfoil surface including a concave surface, a convex surface, a leading edge surface, a trailing edge spaced apart from the leading edge surface, the leading edge surface and the trailing edge each disposed between the concave surface and the convex surface, an airfoil tip at a radial outer edge of the airfoil surface, and a platform at an airfoil surface radially inner edge; and, a thermal insulating outer layer on at least one airfoil surface region, the region being:

a) less than all of the airfoil surface, and, b) selected from the airfoil surface which has been observed to experience more strenuous environmental operating conditions during service operation than the airfoil surface outside of the region;

the region including at least a part of the leading edge surface, and the concave surface at least at the leading edge surface; and the region further includes at least a part of the concave surface at the radially inner edge, extending generally across the concave surface from the leading edge surface toward the trailing edge.

2. The article of claim 1 in which the region includes substantially the entire concave surface and the leading edge surface.

3. The article of claim 2, in the form of an air cooled blading member which includes cooling air discharge openings in the concave surface at the trailing edge, wherein the cooling air discharge openings are outside of the region.

4. The article of claim 3 in which the thermal insulating outer layer is a ceramic TBC material.

* * * * *

UNITED STATES PATENT AND TRADEMARK OFFICE

CERTIFICATE OF CORRECTION

PATENT NO. : 6,364,608 B1
DATED : April 2, 2002
INVENTOR(S) : Brainch et al.

It is certified that error appears in the above-identified patent and that said Letters Patent is hereby corrected as shown below:

Title page,
Item [*], Notice, delete the phrase "by 0 days" and insert -- by 12 days --

Signed and Sealed this

Twenty-first Day of September, 2004

JON W. DUDAS
*Director of the United States Patent and Trademark Office*